US006079910A

United States Patent [19]

Marianski et al.

[11] Patent Number: 6,079,910

[45] Date of Patent: Jun. 27, 2000

[54] COLUMN CRIBBING SYSTEM

[76] Inventors: James E. Marianski; Andrew J. Marianski, both of 328 Gallway Rd., Bristol, Tenn. 37620

[21] Appl. No.: 09/157,663

[22] Filed: Sep. 21, 1998

[51] Int. Cl.[7] ..... E21D 15/48; E21D 17/00

[52] U.S. Cl. ..... 405/288; 52/233; 405/273

[58] Field of Search ..... 405/288, 303, 405/272, 273; 52/233; 446/106, 85

[56] References Cited

U.S. PATENT DOCUMENTS

| | | | |
|---|---|---|---|
| 1,402,438 | 1/1922 | Nichols . | |
| 2,190,556 | 2/1940 | Wiebecke et al. | 262/1 |
| 2,832,100 | 4/1958 | Swallert . | |
| 4,840,003 | 6/1989 | Lucas et al. | 52/233 |
| 4,997,315 | 3/1991 | Clark | 405/273 |
| 5,015,125 | 5/1991 | Seegmiller | 405/288 |
| 5,143,484 | 9/1992 | Deul | 405/288 |
| 5,435,670 | 7/1995 | Pienaar et al. | 405/289 |
| 5,746,547 | 5/1998 | Reinmann et al. | 405/288 |

FOREIGN PATENT DOCUMENTS

| | | |
|---|---|---|
| 5545953 | 3/1980 | Japan . |
| 852519 | 4/1985 | South Africa . |
| 862467 | 4/1986 | South Africa . |
| 911265 | 2/1991 | South Africa . |
| 923628 | 5/1992 | South Africa . |
| 934786 | 7/1993 | South Africa . |
| 2270934 | 3/1994 | United Kingdom . |
| 7900567 | 8/1979 | WIPO . |

*Primary Examiner*—Dennis L. Taylor

*Attorney, Agent, or Firm*—Webb Ziesenheim Logsdon Orkin & Hanson, P.C.

[57] ABSTRACT

A mine cribbing system includes a mine cribbing column having a discrete number of sides, each side including a series of stacked blocks. Each block includes an elongated body and a pair of spaced slots extending into one side of the body. The slots are utilized for interconnecting the adjacent sides. Preferably, the column is a three-sided structure with a first pair of slots in each body extending ⅓ of the thickness of the body and a second slot of each body extending in ⅔ of the thickness of the body.

16 Claims, 6 Drawing Sheets

COLUMN CRIBBING SYSTEM

BACKGROUND OF THE INVENTION

1. Field of the Invention

The present invention relates to a mine cribbing system, more particularly, to a mine support column having a plurality of interconnected sides.

2. Background Information

Mine cribbing systems, also known as packs, are widely used in underground mines to provide yielding support for the mine roof, or the like. Such cribbing is conventionally formed from lengths of wood, also referred to as blocks, logs or chalks. The wood is arranged in a series of overlaying layers to form a column extending from the floor of the mine to the supported roof, or other supported structure. In order to avoid slippage due to vertical loading, individual pieces of the cribbing have been notched to interlock individual blocks with the overlaying blocks of adjacent sides. U.S. Pat. No. 5,746,547 to Reinmann et al. ("the Reinmann patent") further modifies the overlying arrangement of the prior art. The Reinmann patent provides a cribbing column in which the load from a block in each layer can be transferred to the block immediately below along the entire length of the block, rather than only at the crossing points of blocks of adjacent sides. The cribbing column of the Reinmann patent has the disadvantage of being limited to a four-sided column. The four-sided column arrangement does not minimize the amount of wood necessary for constructing a cribbing system.

The object of the present invention is to provide a cribbing system which is formed of a column of interconnected sides which allows the loads to be transferred from each block to an underlying block along the entire length of the block and which avoids the disadvantages of the above cited prior art.

SUMMARY OF THE INVENTION

The objects of the present invention are achieved with a mine cribbing system according to the present invention which is formed as a three-sided column. Each side of the column includes a series of stacked blocks, wherein block between the ends of the series of stacked blocks are interconnected with at least one block of each remaining side. In general, each block will include a pair of spaced slots on one side thereof, wherein the interconnection of each block to the blocks of the remaining sides includes receiving at least one block of each remaining side in one of the pair of spaced slots. Each side of each column is formed such that the blocks are supported along their entire length, wherein the forces from one block can be transferred to the block below along substantially the entire length of the block.

In one embodiment of the present invention, each block in each of the pair of slots are substantially rectangular with each slot extending across one side of the block at an angle of about 60 degrees relative to the longitudinal axis of the block and converging toward each other in a V formation. The first of the slots of each block can extend into the block about one-third of the thickness of the block with the other of the pair of slots of each block extending into the block about two-thirds of the thickness of the block.

The mine cribbing system of the present invention is not limited to a three-sided cribbing system. The present invention can be formed as a column having any discrete number of sides, with each side including a series of stacked blocks and each block having an elongated body with a pair of slots extending into one side of the body. The first of the pair of slots extends into the body a distance of 1/X of the thickness of the body. The second slot of the pair of slots extends into the body a distance of (X−1)/X of the thickness of the body, where X equals the number of sides of the column, and the angle of the slots would be 180°/X.

In the mine cribbing system according to the present invention, each side of the cribbing column has an adjacent series of stacked blocks on adjacent sides which are offset from the series of stacked blocks on that side by a fraction of the thickness of one block with the offset of the adjacent sides being in opposite directions relative thereto. In one embodiment of the present invention, the fraction of the thickness of one block is 1/X, where X equals the number of sides of the column. In the three sided column embodiment of the present invention, each adjacent side is offset from one side by one-third of the thickness of the block with the offset being in opposite directions. In other words, for each side, one adjacent side will be arranged in rows one-third higher than the side and the other adjacent side will be arranged in rows one-third lower for a three-sided column.

These and other advantages of the present invention will be clarified in the detailed description of the preferred embodiments taken together with the attached figures wherein like reference numerals represent like elements throughout.

DETAILED DESCRIPTION OF THE PREFERRED EMBODIMENTS

Figure 1:
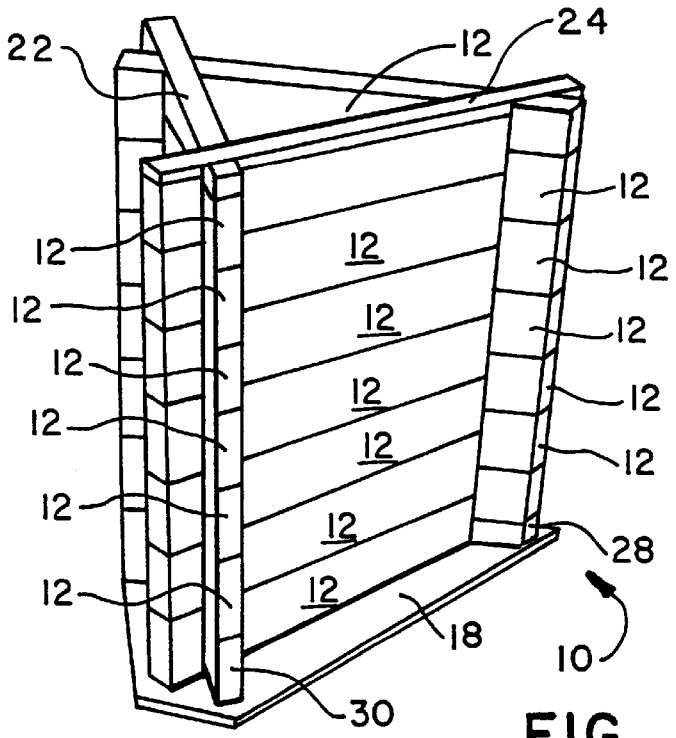
FIGS. 1 and 2 illustrate a mine cribbing system according to the present invention.
Figure 2:
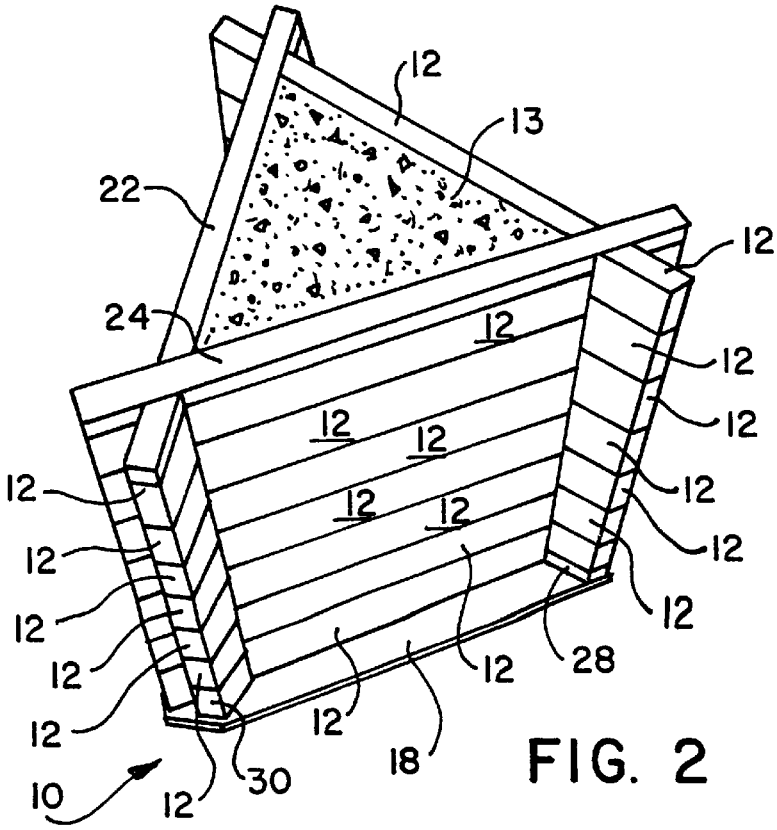

FIGS. 1 and 2 illustrate a mine cribbing system 10 in the form of a three-sided column according to a first embodiment of the present invention. Each side of the column includes a series of stacked standard blocks 12 with each block 12 supported along the length of the block 12 as will be described hereinafter. Additionally, each block 12 is interconnected with adjacent blocks 12 of the two adjacent sides as will be hereinafter described. The three-sided column of the mine cribbing system 10 of the present invention provides significant advantages over the prior art. A rigid support structure is obtained by interconnecting the adjacent sides and a substantial saving in material is provided by forming the column of three sides rather than four as in the Reinmann patent. Additionally the present invention maintains the support for each block along the length of the block. Further, the present invention can be expanded beyond three sided columns.

The interior of the column may be filled with a filler such as precast concrete filler elements 13 as shown in FIG. 2. The concrete filler elements 13 would be preformed to the shape of the interior of the column and stacked in the interior of the column during the construction of the column. The filler elements 13 may also be made of wood or other acceptable material. Alternatively, a foaming filler could be utilized which would be pumped into the interior of the column after the column is essentially completed. The cribbing system 10 of the present invention may be used without a filler element. The filler elements 13 are shown in FIG. 2, but have been omitted from the remaining figures for clarity.

Figure 9:
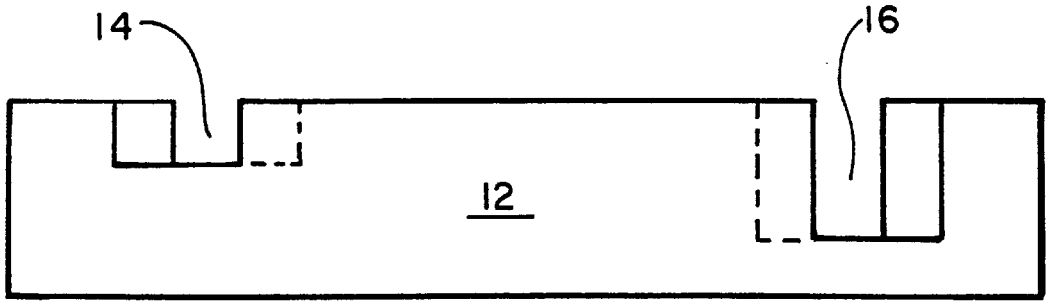
FIG. 9 is a side view of a standard block for the cribbing system illustrated in FIGS. 1–8.
Figure 10:
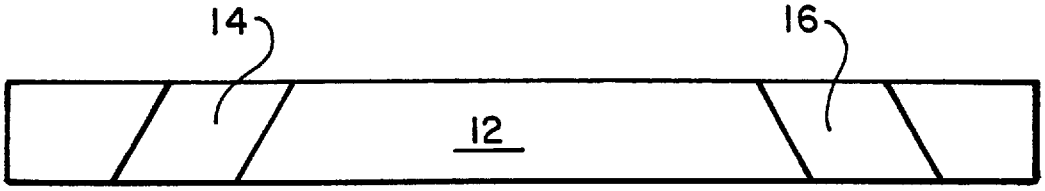
FIG. 10 is a top view of the block illustrated in FIG. 9.

The fundamental element of the cribbing system 10 of the present invention is the standard block 12 shown in detail in FIGS. 9 and 10. The standard block 12 will generally be wood, but can be made of any material appropriate for withstanding the loads in a mine. Wood is accepted in the mining industry and provides the yielding support as is known in the art. The forming of wood the dimensions can be such that the block is made out of a typical 3"×6" board cut to about a 30" length. At a first end of the block 12 is a first rectangular slot 14 extending into the block 12 about ⅓ of the thickness of the block 12 from the top surface thereof. At the opposite end of the block 12 is a second rectangular slot 16 extending ⅔ of the way into the block 12 from the top surface. As best illustrated in FIG. 10, both the rectangular slot 14 and the rectangular slot 16 are angled at about 60° relative to the longitudinal axis of the block 12 and are positioned converging toward each other as shown in FIG. 10.

Figure 3:
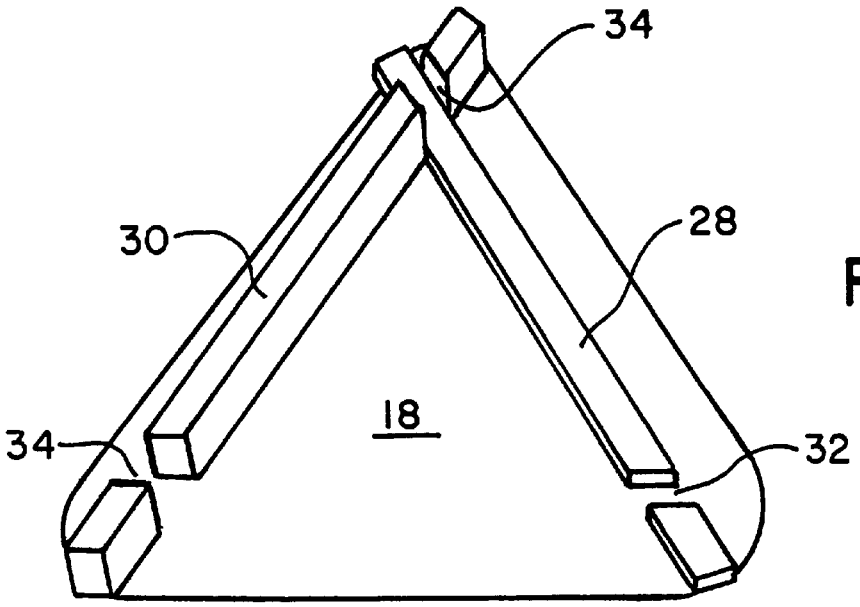
FIGS. 3–8 illustrate the assembly process of the cribbing system illustrated in FIG. 1.

The interconnection of the sides of the column will be understood from a review of FIGS. 3–8 regarding construction of the cribbing system 10. A foundation or base 18 will be useful for forming a level column and specialized cap members 22, 24 will be used for finishing the top level of the column in a planar fashion. FIG. 3 illustrates the base 18 upon which the column is built. Base 18 includes a first side support 28 of a height or thickness of about ⅓ of a block 12 and a second side support 30 of about ⅔ of the height of a block 12. The first side support 28 includes a first rectangular slot 32 extending there through and positioned at an angle of about 60 degrees relative to the longitudinal axis of the first side support 28. The second side support 32 includes a pair of rectangular slots 34 extending there through and also positioned at about an angle of 60 degrees relative to the longitudinal axis of the second side support 30. The first side support 28 extends through one of the slots 34 of the second side support 30 and the other of the slots 34 is aligned with the slot 32 of the first side support 28 as shown in FIG. 3.

Figure 4:
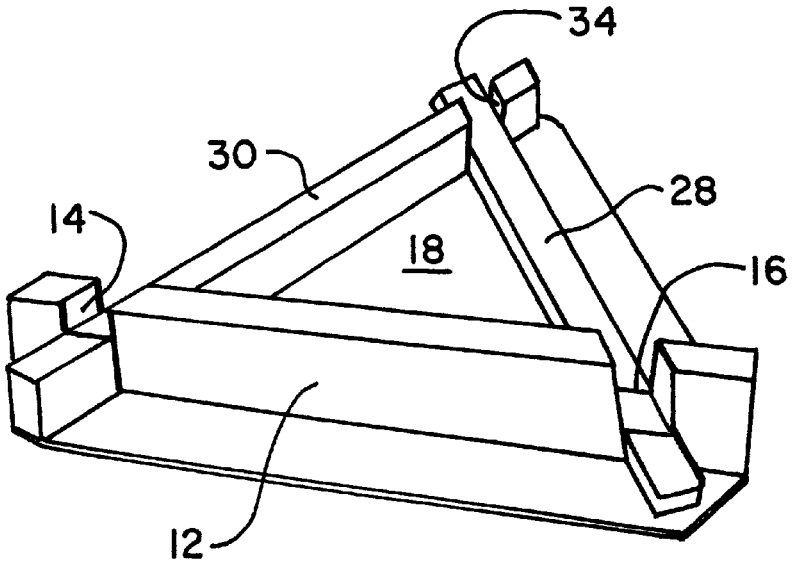

FIG. 4 illustrates the placement of the first standard block 12 on the base 18. The block 12 is placed through the aligned slots 34 and 32 with the slot 14 aligned with the second side support 30 and the slot 16 aligned with the first side support 28. The portion of the block 12 below the slot 14 is received in and substantially fills the slot 34 of the second side support 30 and the portion of the block 12 below the slot 16 is received in and substantially fills the slot 32 of the first side support 28. The block 12 is fully supported along its length by the base 18. The flat portion of the base 18 may be eliminated such that the first side support 28, the second side support 30 and the initial standard block 12 shown in FIG. 4 are fully supported on the floor of the mine.

Figure 5:
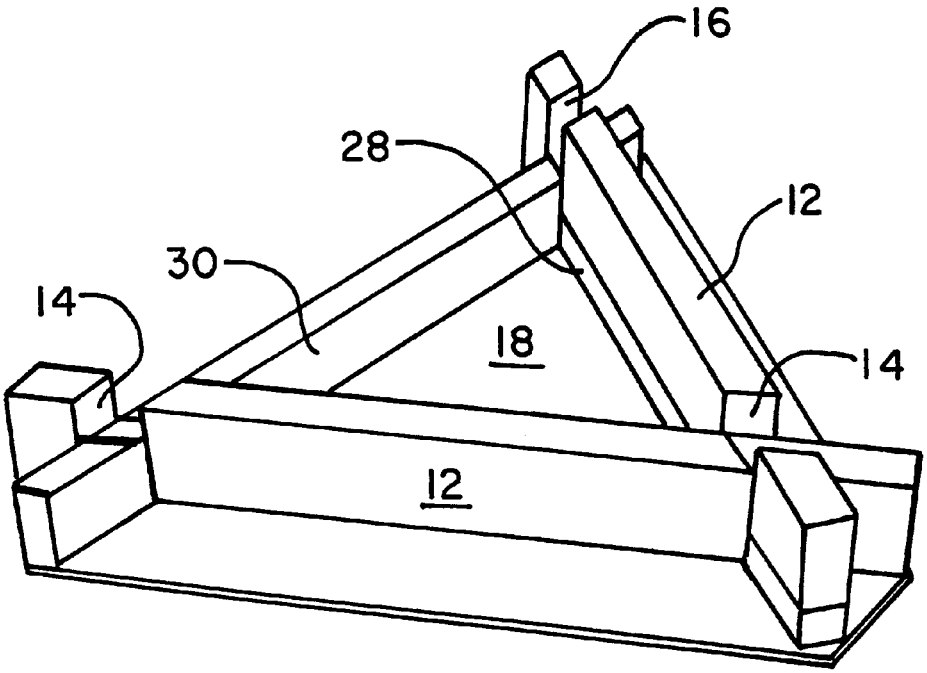

FIG. 5 illustrates the placement of the second standard block 12 on the first side support 28. The second block 12 is placed to extend through the slot 16 of the initial standard block 12 and the slot 34 of the second side support 30 which are aligned. The slot 14 of the second standard block 12 is aligned with the initial standard block 12 and the slot 16 of the second standard block is aligned with the second side support 30. The portion of the second standard block 12 below the slot 14 is received in and substantially fills the slot 16 of the initial standard block 12. The portion of the second standard block 12 below the slot 16 is received in and substantially fills the remaining portion of the slot 34 of the second side support 30. The lower half of this slot 34 is filled with the first side support 28. The second block 12 is fully supported along its length by the first side support 28 and the portion of the initial block 12 below the slot 16. The slot 16 of the second standard block 12 is aligned along the second side support 30 with the slot 14 of the first standard block 12.

Figure 6:
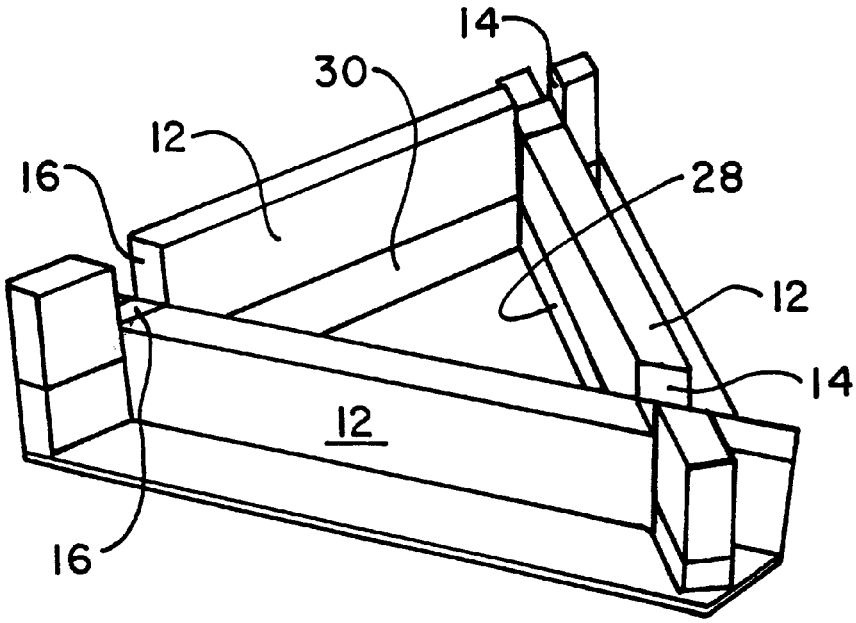

FIG. 6 illustrates the placement of the third standard block 12 on the second side support 30. The third block 12 forms the beginning of the third and final side of the cribbing column. The third block 12 is placed to extend through the slot 14 of the initial standard block 12 and the slot 16 of the second standard block 12 which are aligned along the second side support 30. The slot 14 of the third standard block 12 is aligned with the second standard block 12 on the second side of the column and the slot 16 of the third standard block 12 is aligned with the first standard block 12 on the first side of the column. The portion of the third standard block 12 below the slot 14 is received in and substantially fills the slot 16 of the second standard block 12. The portion of the third standard block 12 below the slot 16 is received in and substantially fills the slot 14 of the initial block 12. The third block 12 is fully supported along it's length by the second side support 30 and the portion of the second block 12 below the slot 16. The slot 16 of the third standard block 12 is aligned along the initial block 12 with the slot 14 of the second standard block 12.

Figure 7:
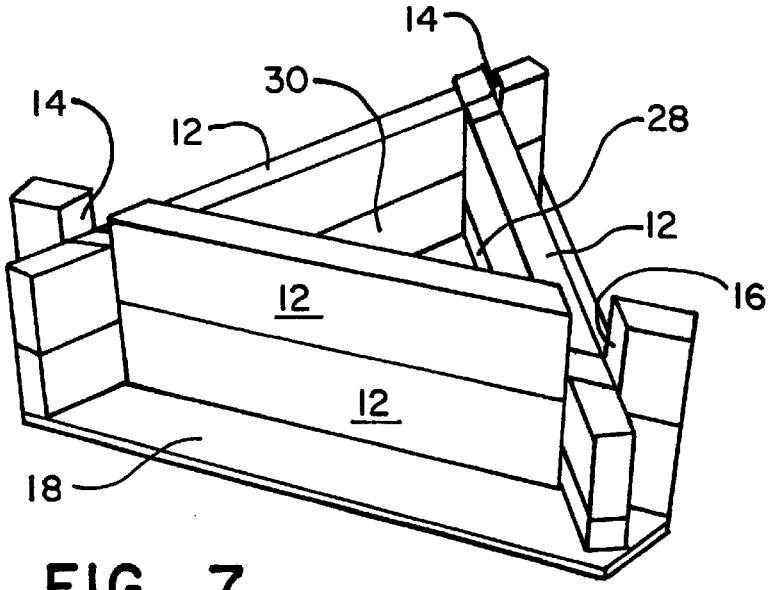

FIG. 7 illustrates the placement of the fourth block 12 on the initial block 12 on the first side of the column. This is essential a repeating of the step shown in FIG. 5 with the second block 12 and the third block 12 acting as the first side support 28 and the second side support 30, respectively. As suggested in FIG. 7 the assembly cycle shown in FIGS. 3–5 is repeated to build up the column for the cribbing system until the desired height is reached.

Figure 8:
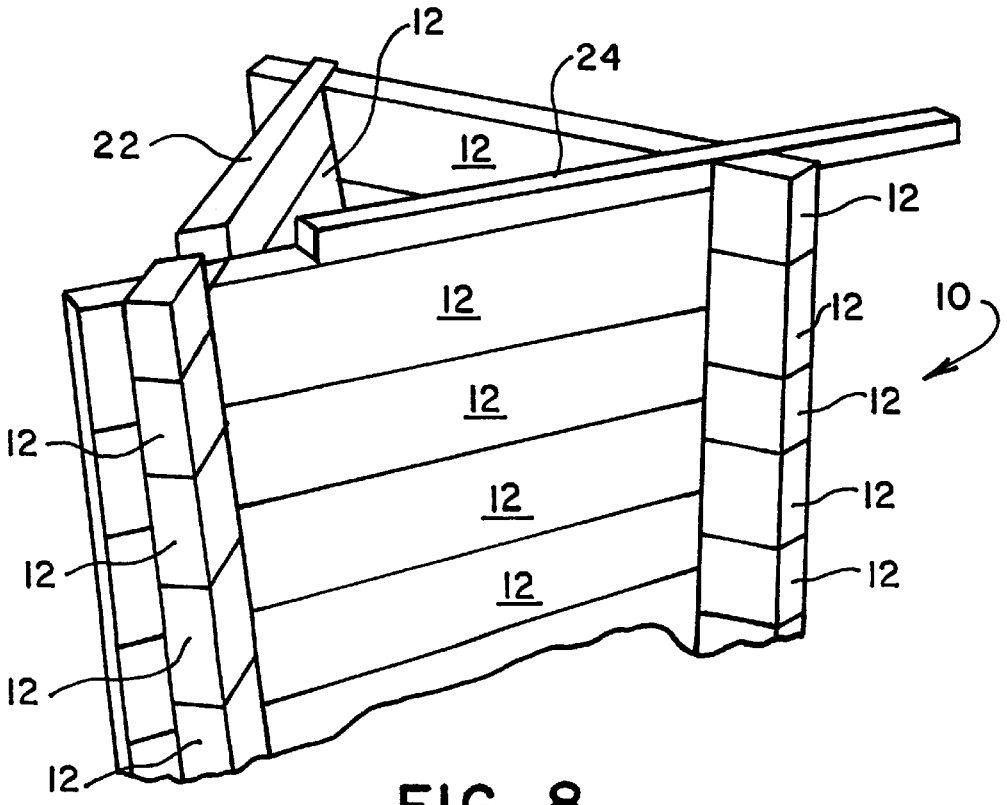

As shown in FIG. 8 after one of the sides is built to the desired height, cap members 22 and 24 are placed on the remaining two sides to even out the column. The cap members 22 and 24 are blocks having a thickness of ⅓ and ⅔ of the thickness of a standard block 12, respectively. The cap member 22 having the ⅔ block thickness will include a slot 36 for receipt of the other cap member 24. In operation the cap members 22 and 24 remove the offset between the sides, which is introduced or provided by the first side support 28 and the second side support 30.

The preferred embodiment of the present invention is to provide a three-sided column as described above. However, the present invention is clearly not limited to this construction. The present invention can be used for mine cribbing column having any specific number of sides. In the more generalized format the block 12 is formed with a pair of slots extending to the body a distance of 1/X of the thickness of the body with the second of the slots extending of the body a distance of (X−1)/X of the thickness of the body wherein X equals the number of sides the mine cribbing column. In the example above there were three sides such that the first slot is ⅓ of the thickness of the body and the second slot is ⅔ of the thickness of the body or block member. Four, five, six, seven or more sides could also be used with straight rectangular body members quoting to this formula. Four, five and six sided mine cribbing systems are shown in FIGS. 11*b–d*. In the generalized construction rectangular slots through the standard block will be angled relative to the longitudinal axis of the body at an angle substantially corresponding to the angle between the sides of an equilateral polygon having X sides where X again refers to the number of sides of the mine cribbing column.

Figure 11A:
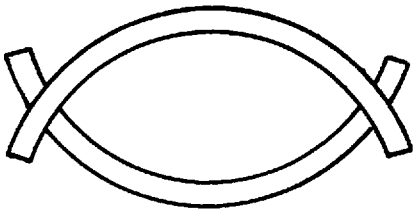
FIGS. 11*a–d* illustrate mine cribbing systems according to modified embodiments of the present invention.
Figure 11B:
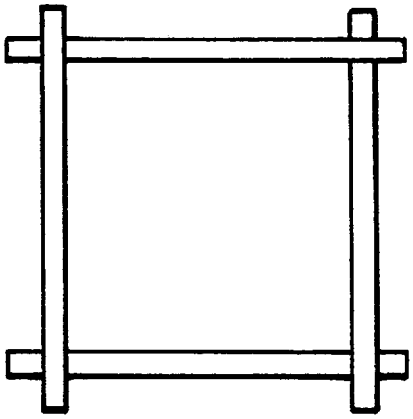
Figure 11C:
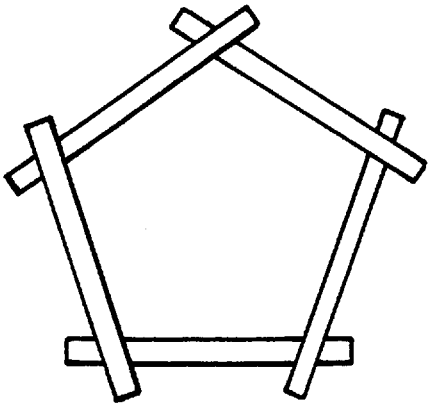
Figure 11D:
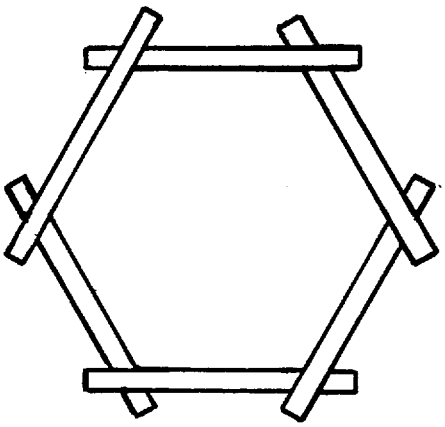

It is contemplated that the present invention could even be utilized for forming a column having two sides as shown in FIG. 11*a*. However, in the two-sided embodiment, the sides must necessarily be curved to an extent such that the ends of each block of the two-sided column can overlap each other for interlocking these members.

An important feature of the present invention is that the blocks 12 interlock with the blocks 12 of adjacent sides and the blocks 12 are maintained fully supported along their length. In the present invention, the column is formed of substantially straight interconnected sides. Each side is formed of a stack of substantially uniform blocks wherein each adjacent side has a series of stacked blocks which are offset from the series of stacked blocks of that side by a specific fraction with the offset of adjacent sides being in opposite directions relative to that side. Specifically, as noticed in the FIGS. 1–8 in the three-sided column, the stack of blocks 12 on each side has a stack of blocks 12 on each adjacent side which are offset by ⅓ of the height of a block 12. With the adjacent sides being offset in opposite directions relative to a given side. Alternatively it could be stated that for each side one adjacent side is offset ⅓ of the height of a block 12 in a first direction and the opposite side is offset ⅓ in the opposite direction, or ⅔ offset in the same direction.

The present invention provides significant advantages over the applied prior art particularly where three sides are utilized. These advantages include significant savings in the amount of wood or components necessary to form an effective cribbing member. Additionally, the triangular shape provides a very secure structure and the concepts of the present invention can be expanded beyond a three-sided column.

It will be evident to those of ordinary skill in the art that various changes and modifications may be made to the present invention without departing from the spirit and scope thereof. Consequently, scope of the present invention is intended to be defined by the attached claims and equivalents thereto.

We claim:

1. A mine cribbing system comprising a three sided column, each side of said column including a series of stacked blocks, wherein each block between the ends of said series of stacked blocks on each said side is interconnected with at least one block of each of the remaining sides, and a base structure supporting said series of stacked blocks.

2. The cribbing system of claim 1 wherein each block includes a plurality of block sides and a pair of spaced slots on one said block side, and wherein said interconnection of each block between the ends of said series of blocks on each said side with at least one block of the remaining sides includes receiving at least one block of each remaining side in one of said pair of spaced slots.

3. The cribbing system of claim 2 wherein each said block and each said slot of said pair of slots is substantially rectangular.

4. The cribbing system of claim 3 wherein each said slot extends across one side of said block at an angle of about sixty degrees relative to a longitudinal axis of said block.

5. The cribbing system of claim 4 wherein a first of said pair of slots of each said block extends into said block about ⅓ of the thickness of said block.

6. The cribbing system of claim 5 wherein a second of said pair of slots of each said block extends into said block about ⅔ of the thickness of said block.

7. A mine cribbing system comprising a mine cribbing column, said column having a discrete number of sides, each said side including a series of stacked blocks, each said block comprising an elongated body defined by a plurality of block sides and a pair of spaced slots extending into said body from one said block side, wherein a first of said pair of slots extends into said body a distance of 1/X of a thickness of said body and a second of said slots extends into said body a distance of (X−1)/X of the thickness of said body, wherein X is equal to the number of sides of said mine cribbing column, and said mine cribbing column including a base structure supporting said series of stacked blocks.

8. The cribbing system of claim 7 wherein at least one block of each said side of said column receives one block of one adjacent side in a first of said pair of slots and one block of another adjacent side in a second of said pair of slots.

9. The cribbing system of claim 7 wherein said number of sides of said column is less than four and wherein each said side is interconnected with each of the remaining sides of said column.

10. The cribbing system of claim 8 wherein each said slot extends across said block at an angle relative the longitudinal axis of each said block and wherein said slots are angled toward each other.

11. A mine cribbing system comprising a column having a number of substantially straight interconnected sides, each said side formed of a series of stacked substantially uniform blocks, wherein for each said side of said column adjacent series of stacked blocks on adjacent sides are offset from said series of stacked blocks of said side of said column by a fraction of the thickness of one said block with said offset of said adjacent sides being in opposite directions relative to said side of said column, and said column including a base structure supporting said series of stacked blocks, wherein said base structure and said uniform blocks are dimensioned to provide said offset of adjacent sides.

12. The mine cribbing system of claim 11 wherein said fraction of the thickness of one said block is 1/X wherein X is a number of said sides of said column.

13. The mine cribbing system of claim 11 wherein each said side is interconnected with each remaining side of said column.

14. The mine cribbing system of claim 11, wherein each said block includes an elongated body defined by a plurality of block sides and a pair of spaced slots extending into said body from one said block side, wherein a first of said pair of slots extends into said body a distance of (X−1)/X of the thickness of said body, wherein X is equal to the number of sides of said mine cribbing column.

15. The mine cribbing system of claim 14 wherein said column has three sides such that in each said block said first slot extends ⅓ of the thickness of said body and said second slot extends ⅔ of the thickness of said body.

16. The mine cribbing system of claim 15 wherein each said slot is substantially rectangular and extends across the side of said body at an angle of about sixty degrees relative to a longitudinal axis of said body and wherein said slots are angled toward each other in a direction of said adjacent sides.

* * * * *

UNITED STATES PATENT AND TRADEMARK OFFICE

CERTIFICATE OF CORRECTION

PATENT NO. : 6,079,910
DATED : June 27, 2000
INVENTOR(S) : James E. Marianski et al.

It is certified that error appears in the above-identified patent and that said Letters Patent is hereby corrected as shown below:

Claim 10, column 6,
Line 22, "claim 8" should read -- claim 7 --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*